United States Patent [19]

Repplinger

[11] 3,995,365

[45] Dec. 7, 1976

[54] METHOD OF FORMING ELECTRICAL CONTACTS

[75] Inventor: Thomas J. Repplinger, Cary, Ill.

[73] Assignee: Otto Engineering, Inc., Carpentersville, Ill.

[22] Filed: Jan. 13, 1975

[21] Appl. No.: 540,387

[52] U.S. Cl. ..... 29/630 C; 29/622; 29/630 B; 113/119

[51] Int. Cl.[2] ..... H01R 9/22

[58] Field of Search ..... 29/622, 630 R, 630 C, 29/630 B, 628; 200/67 D, 67 DA, 67 DB, 246, 283; 113/119; 72/324, 338, 341

[56] References Cited

UNITED STATES PATENTS

| | | | |
|---|---|---|---|
| 2,646,613 | 7/1953 | Enzler | 29/630 C |
| 2,700,087 | 1/1955 | Stevens | 29/630 C X |
| 2,854,074 | 9/1958 | Frank et al. | 29/624 X |
| 2,984,893 | 5/1961 | Spooner | 29/630 C |
| 3,075,281 | 1/1963 | Spooner | 29/630 C |
| 3,164,708 | 1/1965 | Theobald | 200/252 |
| 3,229,357 | 1/1966 | Burstin | 29/630 C |
| 3,263,306 | 8/1966 | Chapin et al. | 29/622 |

FOREIGN PATENTS OR APPLICATIONS

| | | |
|---|---|---|
| 737,998 | 10/1955 | United Kingdom |

*Primary Examiner*—James R. Duzan

[57] ABSTRACT

A method of forming an electrical contact in an electrical component includes the steps of punching an opening in the electrical component, moving a strip of contact material over the electrical component, shearing a piece of contact material from the strip and inserting it into the opening, and forming the piece into a contact.

5 Claims, 13 Drawing Figures

METHOD OF FORMING ELECTRICAL CONTACTS

BACKGROUND

This invention relates to electrical components which include electrical contacts and has particular utility for electrical components in which the contacts are formed of precious metal such as silver or the like.

Conventional methods of inserting a contact onto a base member or electrical component, such as a terminal, switchblade, or the like, include the steps of fabricating a nonprecious metal base member, fabricating a precious metal contact by coining, cold heading, or the like, and joining the base member and the contact.

The disadvantages of the foregoing method include difficulty in handling and orienting a loose contact prior to securement to the base member, the complexity of the machinery required to locate the contact with respect to the base member and to insert the contact, the cost of using three separate operations to form the part, and the possibility of having scrap or excess precious metal after the contact is fabricated.

SUMMARY OF THE INVENTION

The invention permits electrical components to be formed continuously without any scrap or waste of precious metal. The base member is progressively formed in a progressive die, and the contact material is cut from a feed wire and punched into an opening in the base member in a single operation at one of the stations of the progressive die. The strip from which the base members are formed and the wire of contact material are fed together through the die to eliminate orientation and location problems, and the electrical components can be formed in an ordinary punch press. A rectangular hole is punched in the base member strip, and a slug of precious metal is sliced or sheared from the wire of contact material into the rectangular opening so that the precious metal extends both above and below the base member. The precious metal is then double-headed at subsequent stations of the progressive die to form the finished contact.

DESCRIPTION OF THE DRAWING

The invention will be explained in conjunction with an illustrative embodiment shown in the accompanying drawing, in which.

DESCRIPTION OF SPECIFIC EMBODIMENT

Figures 1, 1A:
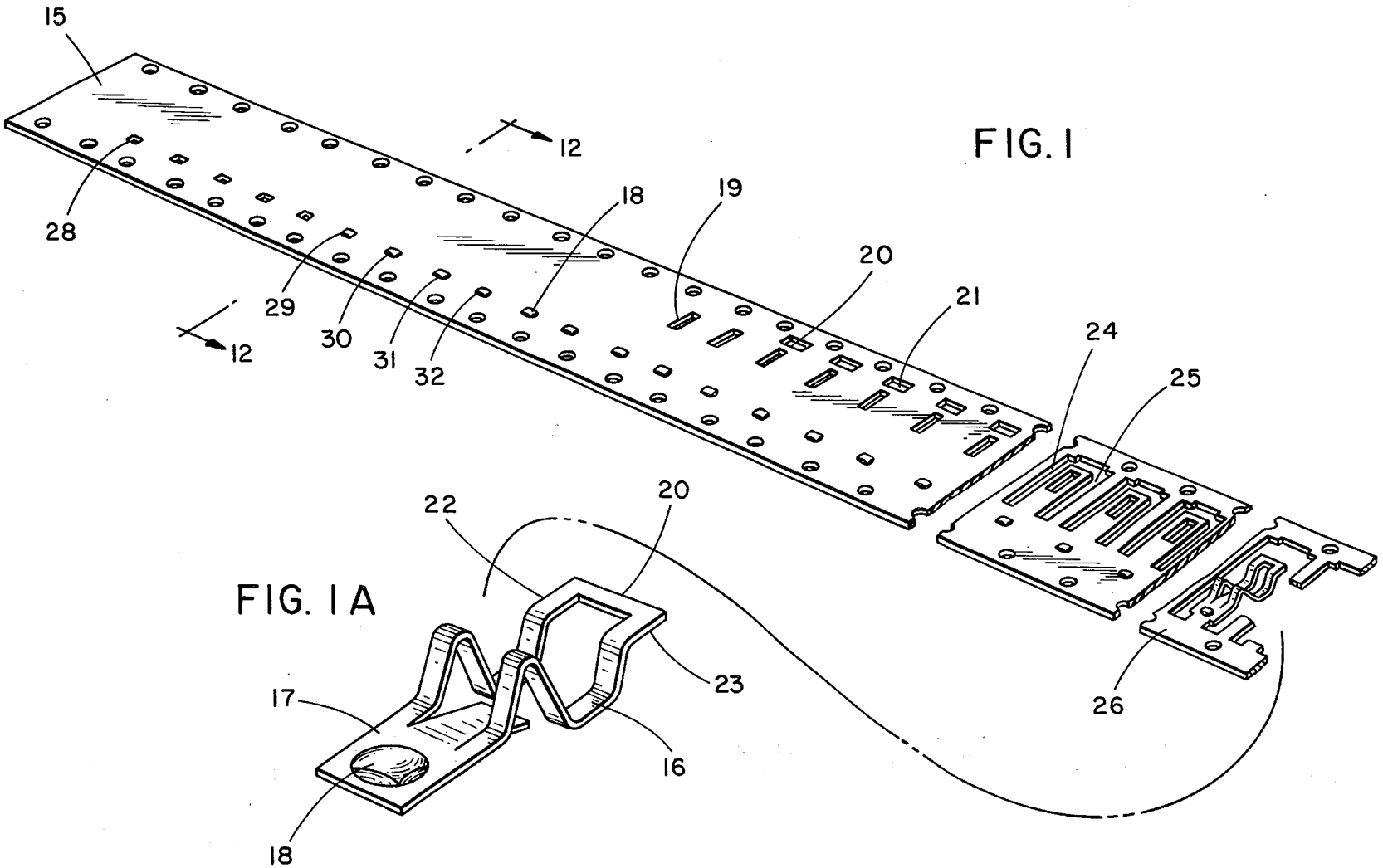
FIG. 1 is a perspective view of a strip of metal which has passed through a progressive die for forming an electrical switch member.
FIG. 1A is an enlarged perspective view of a completed switch member formed by the progressive die.

Referring first to FIG. 1, the numeral 15 designates generally a strip of material which can be fed into a conventional progressive die or punch press to form the base member of an electrical component to which a contact member is to be secured. FIG. 1A illustrates the completed electrical component 16, which in the embodiment illustrated is a switchblade of an electrical switch comprising an electrically conductive metal base member 17 and an electrically conductive contact 18. The switchblade 16 is formed in accordance with co-owned, co-pending application entitled "Electrical Switch", Ser. No. 439,300, filed Feb. 4, 1974, now U.S. Pat. No. 3,878,347, to which reference may be had for details.

The metal base member is progressively formed from the strip 15 of base metal by a conventional progressive die which performs various operations on the strip at work stations in the die as the strip is moved intermittently through the die. For example, an elongated rectangular opening 19 is punched in the strip at one of the stations, the end edge 20 of the base member is formed by an opening 21 punched at another station, and side edges 22 and 23 are formed by openings 24 and 25, respectively, punched at still another station. The switchblade is completely formed at subsequent stations (not illustrated), and the connecting portion 26 is punched out at the last station to free the completed switchblade 16 shown in FIG. 1A.

The contact 18 may be secured to the base member and formed either before or after the base member is completed or during any of the intermediate steps in the formation of the base member. In the particular progressive die whose operations are illustrated in FIG. 1, the contact is secured and formed prior to the formation of the base member, but many variations in the sequence of the operations can be made.

The first step in the method of securing the contact is the punching of a rectangular opening 28 in the base metal strip 15. Thereafter, a slug 29 of contact material is pressed into the opening at a subsequent station of the die. Portions of the contact material slug extend both above and below the base metal strip, and both of these portions of the slug are coined or formed at one or more subsequent stations, for example, stations indicated by the reference numerals 30, 31, and 32, until the desired contour of the contact is obtained. The coining operations not only shape the contact but clinch the contact material over the base metal beyond the edges of the opening 28 to firmly secure the contact to the base metal.

I have found it extremely advantageous to obtain the slug of contact material from a round strip of wire of precious metal, such as silver or the like. Wire is a very common form for various silver alloys, and contact material in wire form is readily available. Also, silver wire is generally less expensive than silver flat stock. The use of wire rather than flat stock permits the contact securing process to be integrated with the process for forming the base member in the progressive die by simple tools. A slug of contact material can be punched from the wire and inserted into the opening in the base member in one operation, and the process is entirely scrapless, i.e., there is no waste of the expensive precious metal.

Figure 12:
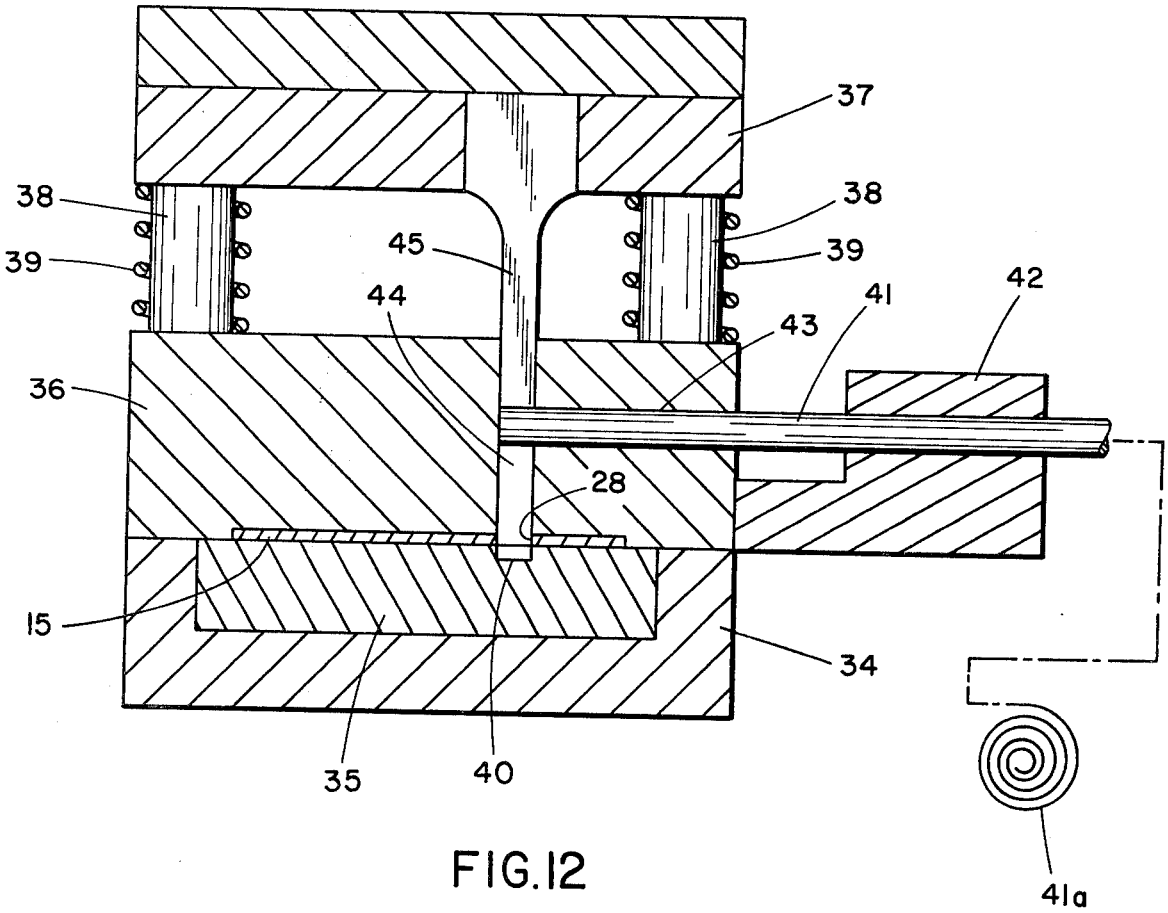
FIG. 12 is a sectional view of a portion of the progressive die showing the step of punching the slug of precious metal into an opening in the base member.

FIG. 12 illustrates a cross sectional view through the progressive die as would be seen at the position indicated by the line 12—12 of FIG. 1. The progressive die includes a base pad 34, and lift pad 35, a pressure pad 36, and a reciprocal punch support 37 which is mounted on support shafts 38. The shafts 38 are slidably mounted in the pressure pad and are biased upwardly to the position illustrated in FIG. 12 by coil springs 39.

The bottom of the pressure pad 36 is provided with a rectangular recess for guiding the base member strip 15, and the lift pad 35 is provided with a rectangular opening 40 which corresponds to the opening 28 in the base member. A round wire 41 is fed from a supply spool 41a through a wire feed mechanism 42 which includes conventional means for advancing the wire. The wire is advanced through a bore 43 in the pressure pad into a square bore 44 in the pressure pad. A punch 45 having a rectangular cross section is mounted on the punch pad and is reciprocable in the bore 44.

The intermittently moving base strip 15 is brought to rest so that the rectangular opening 28 therein is aligned with the recess 40 in the lift pad and the bore 44 in the pressure pad. The precious metal wire 41 is fed into the progressive die in a direction perpendicular to the direction in which the base strip 15 is moved, and when movement of the strip is stopped, the punch 45 is moved downwardly to sever a slug of metal from the wire 41 and to push the slug through the opening 28 in the base strip. The punch also deforms the slug slightly to clinch the slug to the base strip sufficiently to permit the slug to be carried by the strip to subsequent stations of the progressive die for sizing and finishing. The diameter of the wire is no greater than the dimension of the punch in the direction in which the base strip 15 moves so that the severing of the slug from the wire does not leave any scrap.

Figure 2:
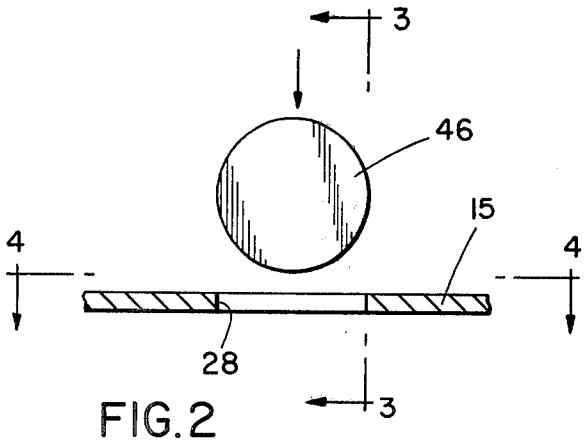
FIG. 2 is an enlarged view showing the step of inserting a slug of contact material into an opening in the base member.
Figure 3:
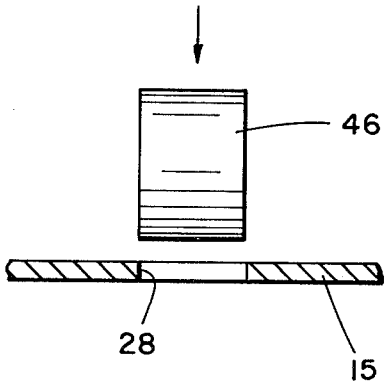
FIG. 3 is a sectional view taken along the line 3—3 of FIG. 2.
Figure 4:
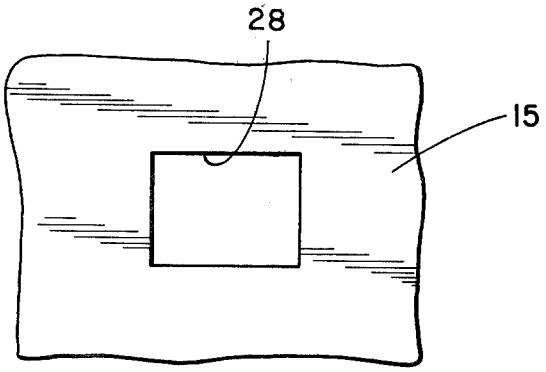
FIG. 4 is a fragmentary plan view of the base member taken along the line 4—4 of FIG. 2.

The contact punching and finishing operations are illustrated in FIGS. 2–11. FIGS. 2 and 3 illustrate the slug 46 after it has been punched from the supply wire and as it is being forced downwardly by the punch in the direction of the arrow toward the opening 28 in the base strip 15. For clarity of illustration the various parts of the progressive die are omitted from FIGS. 2–11.

Figure 5:
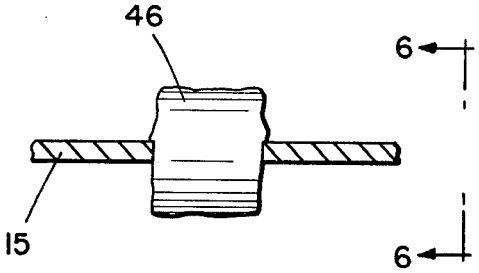
FIG. 5 is a view similar to FIG. 3 showing the slug inserted into the opening.
Figure 6:
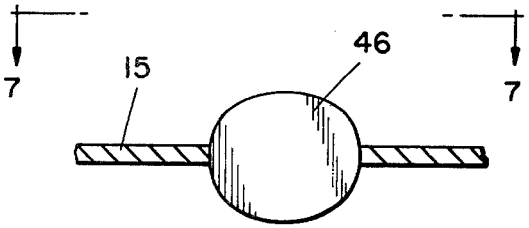
FIG. 6 is a view taken along the line 6—6 of FIG. 5.
Figure 7:
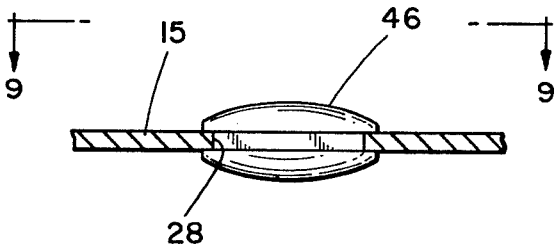
FIG. 7 is a view similar to FIG. 4 taken along the line 7—7 of FIG. 6.

FIGS. 5–7 illustrate the slug 46 after it has been pushed into the opening in the base strip. The slug is sized to be frictionally retained in the opening and is deformed slightly from its original shape (FIGS. 2 and 3) so that it is clinched somewhat to the base strip.

Figure 8:
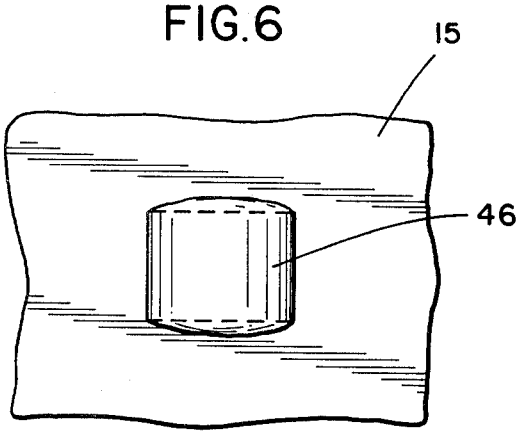
FIG. 8 is a view similar to FIG. 6 showing the slug after a subsequent forming operation.
Figure 9:
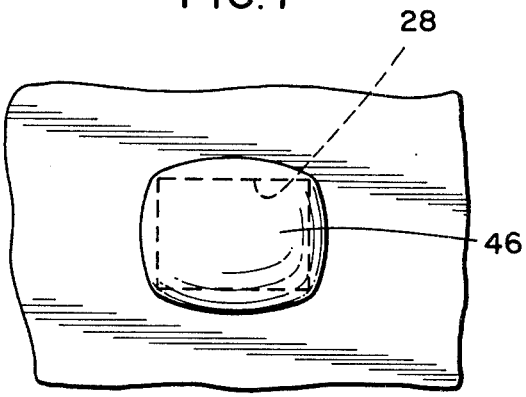
FIG. 9 is a view taken along the line 9—9 of FIG. 8.
Figure 10:
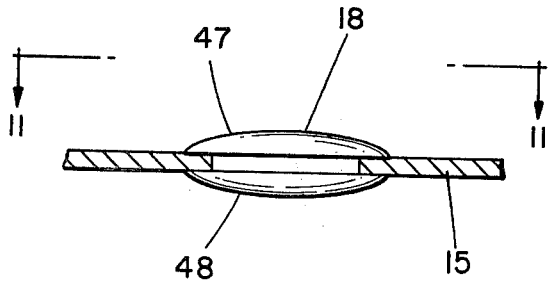
FIG. 10 is a view similar to FIG. 8 showing the completely formed contact.
Figure 11:
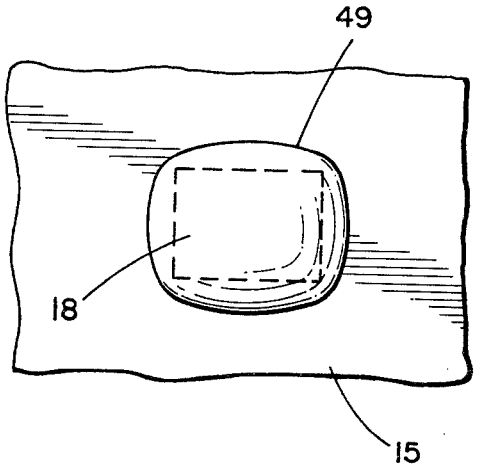
FIG. 11 is a view taken along the line 11—11 of FIG. 10 showing the completely formed contact.

As the strip 15 is moved to the next station of the die, the slug is carried along with the strip. FIGS. 8 and 9 illustrate the slug 46 after a subsequent coining or forming operation performed by the die which deforms the slug over peripheral portions of the base strip around the opening. FIGS. 10 and 11 illustrate the completed contact 18 after the slug has been subjected to one or more subsequent finishing operations at other stations of the die. The completed contact is firmly secured to the base strip and is provided with arcuate upper and lower surfaces 47 and 48 and a substantially circular periphery 49. However, the shape of the completed contact can be modified as desired.

The slug is advantageously inserted about half way through the opening in the base strip so that the slug extends substantially equally above and below the base strip. Subsequent forming steps of the contact are double-heading operations which form both the top and the bottom of the contact.

In the punch press whose operations are illustrated in FIG. 1, the switchblade 16 is formed after the contact is secured to the base strip and fully formed. However, it will be understood that the precise order of the forming steps in the progressive die can be varied as desired. Alternatively, the contact securing and forming operations can be performed on individual, completed base members.

The invention simplifies the contact-forming operation and permits this operation to be integrated into an ordinary progressive die as the base member is being stamped at high speed. The contact wire is fed into the die in one direction by a simple attachment as the base strip is moved in another direction, and since the contact wire and the base strip are being fed simultaneously through the die, there are no orientation or location problems.

Although I have described my invention with respect to a switchblade in which the base member is formed of electrically conductive metal, the invention can be used to form many other components. For example, since the contact has a pair of contact surfaces 47 and 48 (FIG. 10), the base member can be formed of insulating material and the contact can be used to close a circuit between two terminals.

While in the foregoing specification, a detailed description of a specific embodiment of the invention was set forth for the purpose of illustration, it is to be understood that many of the details hereingiven may be varied considerably by those skilled in the art without departing from the spirit and scope of the invention.

I claim:

1. A method of forming electrical components comprising the steps of:

a. intermittently moving a flat strip of material in a first plane through a punch press past a plurality of stations in the punch press, b. forming an opening in the strip with the punch press at one of the stations, c. moving a round metal wire into the punch press in a second plane spaced from and generally parallel to the first plane, d. punching an axially extending cylindrical segment from the metal wire through the punch press in a direction perpendicular to the plane of the strip and into an opening in the strip at another station so that the axis of the cylindrical segment lies in the plane of the strip, and e. forming the punched segment of wire into an electrical contact at another station of the punch press.

2. The method of claim 1 including the step of forming the portion of the first strip which carries the contact into an electrical component at other stations.

3. The method of claim 1 in which the metal wire is moved in a direction perpendicular to the direction in which the first strip is moved.

4. The method of claim 1 in which portions of the segment of the metal wire extend above and below the strip after the piece is positioned in the opening in the strip and both of the portions above and below the strip are formed against portions of the strip which surround the opening.

5. The method of claim 1 in which the opening in the strip is formed by a rectangular punch and the metal wire is fed from a spool in a direction perpendicular to the direction in which the strip is moved.

* * * * *